US011718439B2

(12) United States Patent
Woloszyk et al.

(10) Patent No.: US 11,718,439 B2
(45) Date of Patent: Aug. 8, 2023

(54) CONTAINER PRESSURE BASE

(71) Applicant: AMCOR RIGID PACKAGING USA, LLC, Ann Arbor, MI (US)

(72) Inventors: Mark Woloszyk, Chelsea, MI (US); Walter J. Strasser, Cement City, MI (US)

(73) Assignee: AMCOR RIGID PACKAGING USA, LLC, Ann Arbor, MI (US)

( * ) Notice: Subject to any disclaimer, the term of this patent is extended or adjusted under 35 U.S.C. 154(b) by 0 days.

(21) Appl. No.: 17/052,565

(22) PCT Filed: May 11, 2018

(86) PCT No.: PCT/US2018/032192
§ 371 (c)(1),
(2) Date: Nov. 3, 2020

(87) PCT Pub. No.: WO2019/216905
PCT Pub. Date: Nov. 14, 2019

(65) Prior Publication Data

US 2021/0362903 A1 Nov. 25, 2021

(51) Int. Cl.
*B65D 1/02* (2006.01)

(52) U.S. Cl.
CPC ..... *B65D 1/0276* (2013.01)

(58) Field of Classification Search
CPC .. B65D 1/0284; B65D 1/0276; B65D 1/0261; B65D 1/02; B65D 79/00; B65D 79/0081
See application file for complete search history.

(56) References Cited

U.S. PATENT DOCUMENTS 3,871,541 A * 3/1975 Adomaitis ..... B65D 1/0284 220/608
4,525,401 A * 6/1985 Pocock ..... B29C 45/26 215/373
4,850,494 A * 7/1989 Howard, Jr. ..... B65D 1/0284 220/606
5,906,286 A 5/1999 Matsuno et al.
5,989,661 A * 11/1999 Krishnakumar ..... B29C 49/071 220/675
8,485,375 B2 * 7/2013 Colloud ..... B65D 1/0284 220/606
9,139,328 B2 * 9/2015 Miura ..... B65D 1/0284
9,694,930 B2 * 7/2017 Lane ..... B29D 22/003
(Continued)

FOREIGN PATENT DOCUMENTS

EP 0633857 B1 9/1996

OTHER PUBLICATIONS

International Search Report and Written Opinion of the ISA issued in PCT/US2018/032192, dated Feb. 12, 2019; ISA/KR.

*Primary Examiner* — Ernesto A Grano
*Assistant Examiner* — Symren K Sanghera
(74) *Attorney, Agent, or Firm* — Harness, Dickey & Pierce, P.L.C.

(57) ABSTRACT

A polymeric container formed from a preform and configured for storing a commodity under pressure. A base of the container includes a standing ring configured to support the container upright when the standing ring is seated on a planar standing surface. A curved diaphragm of the base extends from the standing surface to a center of the base. A plurality of dimples are defined by the base and are evenly spaced apart along the standing surface.

14 Claims, 6 Drawing Sheets

(56) References Cited

U.S. PATENT DOCUMENTS

| | | | | |
|---|---|---|---|---|
| 2007/0045220 | A1* | 3/2007 | Pedmo | B65D 1/0284 215/375 |
| 2007/0262046 | A1* | 11/2007 | Zoppas | B65D 1/0284 215/375 |
| 2009/0308835 | A1* | 12/2009 | Bou | B65D 1/0284 215/370 |
| 2010/0032404 | A1* | 2/2010 | Colloud | B65D 1/0284 215/371 |
| 2010/0072165 | A1* | 3/2010 | Schau | B65D 1/0284 215/371 |
| 2012/0156335 | A1* | 6/2012 | Nishibe | B65D 1/0284 220/608 |
| 2014/0227399 | A1* | 8/2014 | Wortmann | B29C 49/18 426/106 |
| 2015/0144587 | A1* | 5/2015 | Hanan | B65D 1/0223 215/382 |
| 2015/0259090 | A1* | 9/2015 | Dorn | B65D 1/0276 215/371 |
| 2017/0096249 | A1* | 4/2017 | Lane | B67C 3/22 |
| 2017/0217625 | A1* | 8/2017 | Steward | B29C 49/22 |
| 2017/0267390 | A1* | 9/2017 | Chiang | B65B 3/022 |
| 2018/0044050 | A1* | 2/2018 | Joshi | B65D 1/0284 |
| 2018/0127137 | A1* | 5/2018 | Mahajan | B65D 1/0276 |

* cited by examiner

CONTAINER PRESSURE BASE

CROSS-REFERENCE TO RELATED APPLICATION

This application is a U.S. National Phase Application under 35 U.S.C. 371 of International Application No. PCT/US2018/032192, filed on May 11, 2018, the entire disclosure of which is incorporated herein by reference.

FIELD

The present disclosure relates to a container pressure base.

BACKGROUND

This section provides background information related to the present disclosure, which is not necessarily prior art.

Various containers exist for storing pressurized contents, such as carbonated soda, sparkling water, champagne, beer, etc. The bases of such containers often include a dome portion, and are known to those skilled in the art as "champagne" bases. While current "champagne" bases are suitable for their intended use, they are subject to improvement. For example, existing champagne bases are capable of withstanding carbonation levels of up to 3.2 g.v. (gas volume). However, there is a need in the art for containers with bases that are capable of withstanding carbonation pressures of greater than 3.2 g.v., such as about 4.2 g.v. The present disclosure advantageously provides for containers for carbonated beverages with "champagne" bases that are able to withstand carbonation pressures of greater than 3.2 g.v., such as about 4.2 g.v. and higher. One skilled in the art will appreciate that the present disclosure provides for numerous additional advantages as well.

SUMMARY

This section provides a general summary of the disclosure, and is not a comprehensive disclosure of its full scope or all of its features.

The present disclosure includes a polymeric container formed from a preform and configured for storing a commodity under pressure. A base of the container includes a standing ring configured to support the container upright when the standing ring is seated on a planar standing surface. A curved diaphragm of the base extends from the standing surface to a center of the base. A plurality of dimples are defined by the base and are evenly spaced apart along the standing surface.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
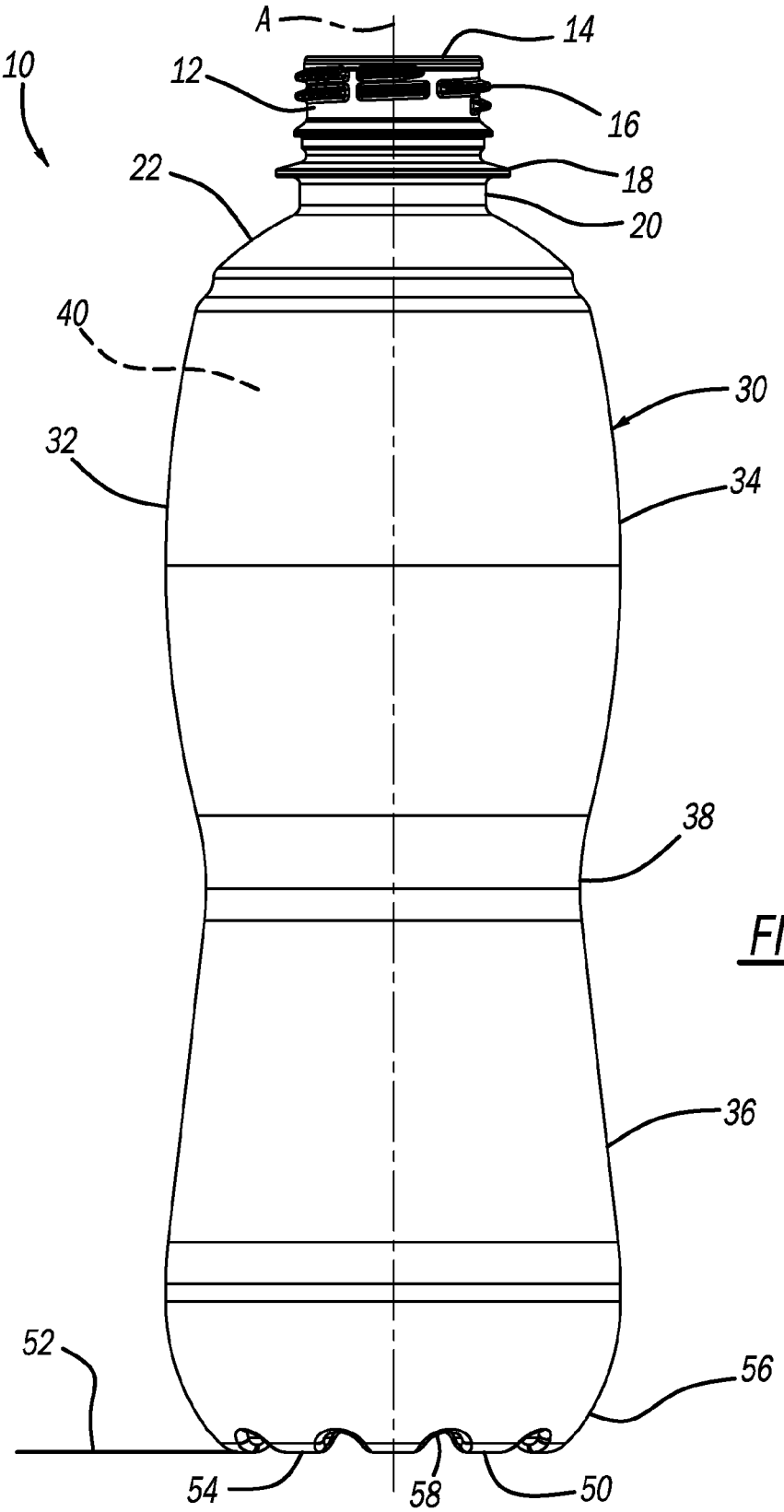
FIG. 1 is a side view of a container in accordance with the present disclosure.
Figure 2:
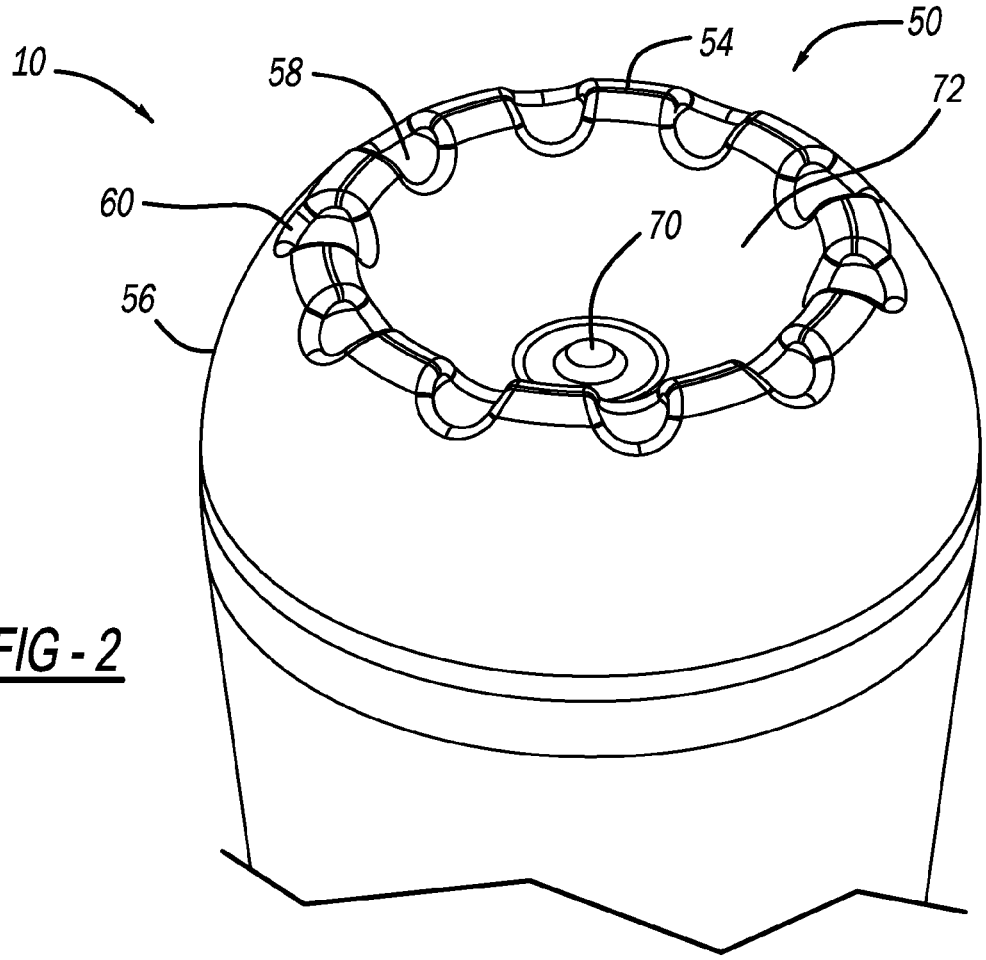
FIG. 2 is a perspective view of a base of the container of FIG. 1.
Figure 3:
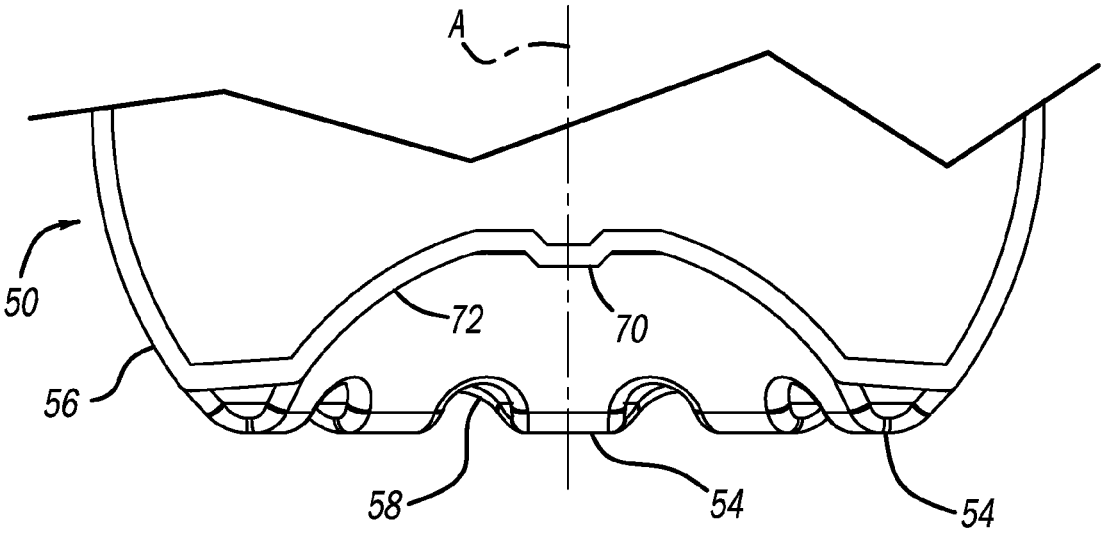
FIG. 3 is a cross-sectional view of the base of FIG. 1.
Figure 4:
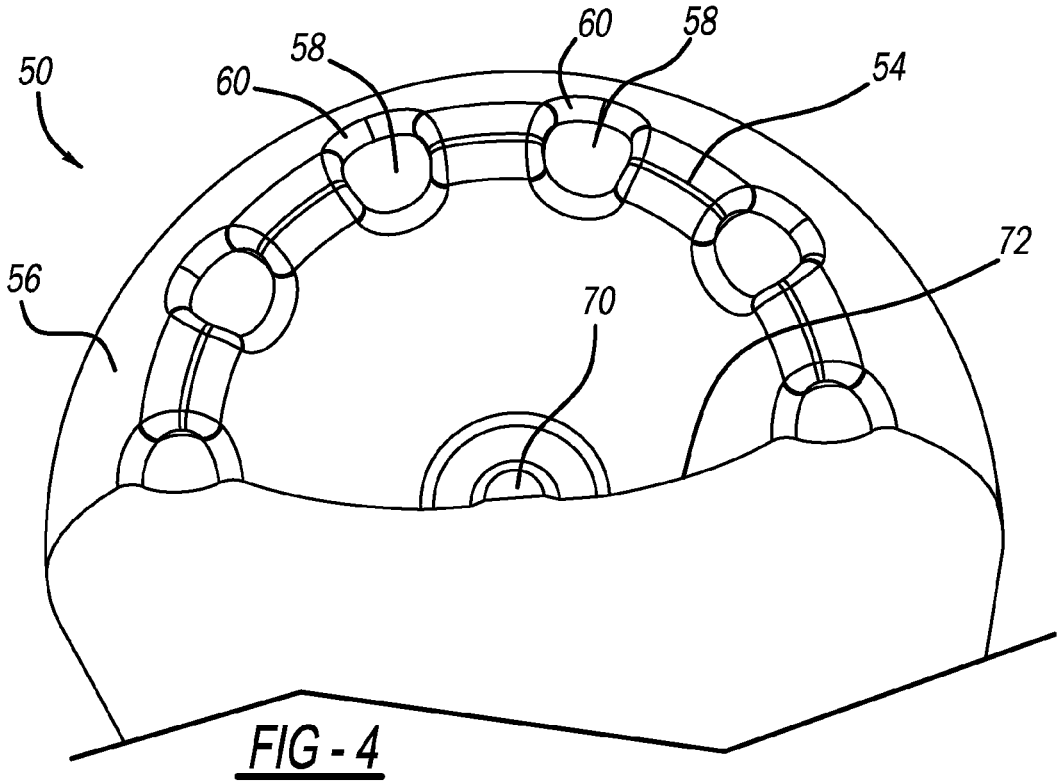
FIG. 4 is another cross-sectional view of the base of FIG. 1.
Figure 5:
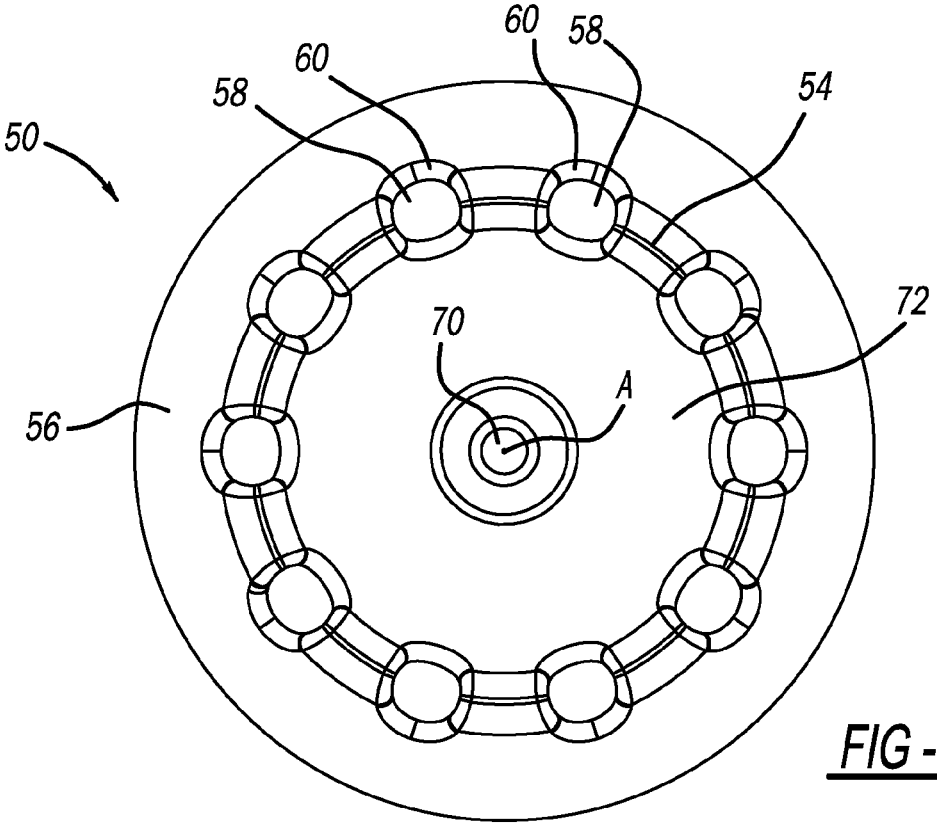
FIG. 5 is a plan view of the base of FIG. 1.
Figure 6:
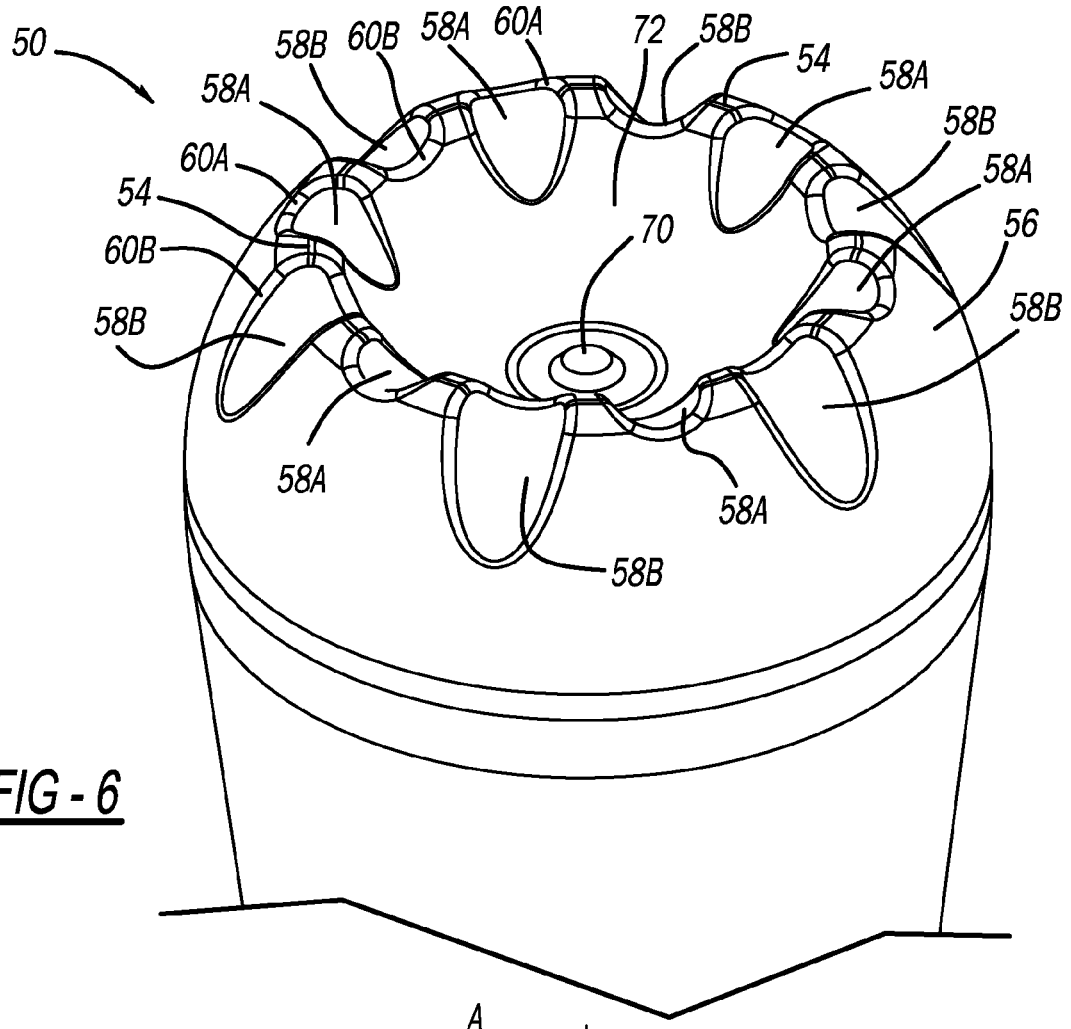
FIG. 6 is perspective view of another base in accordance with the present disclosure.

With initial reference to FIG. 1, a polymeric container in accordance with the present disclosure is illustrated at reference numeral 10. The polymeric container 10 is formed from a preform, and is configured for storing a commodity under pressure. Suitable commodities include, but are not limited to, carbonated soda, sparkling water, champagne, beer, etc. The container 10 can be made of any suitable polymeric material, such as polyethylene terephthalate, low-density polyethylene, high-density polyethylene, polypropylene, and polystyrene, for example.

The container 10 is configured to store the commodity at carbonation levels of 3.2 g.v. (gas volume) or greater, such as 4.2 g.v. This is in contrast to existing containers, which lack sufficient strength and rigidity to store commodities at carbonation levels of greater than 3.2 g.v. As a result, the container 10 advantageously provides for longer shelf life of the commodity because the commodity can be stored at higher carbonation levels. Numerous additional advantages of the container 10 will be described herein.

The container 10 generally includes a finish 12, which defines an opening 14 of the container 10. At an exterior surface of the finish 12 are threads 16, which cooperate with threads of any suitable closure to close the opening 14. The finish 12 further includes a flange 18, which facilitates cooperation between the finish 12 and any suitable forming/filling equipment. The container 10 has a neck 20, which extends from the finish 12 to a shoulder 22 of the container 10. The shoulder 22 is rounded and transitions to a main body 30, which defines an internal volume 40 of the container 10. The container 10 can be any suitably sized container, such as a 14.5 oz. container.

The main body 30 includes a sidewall 32, which is generally circular. The main body 30 is generally divided into an upper body portion 34 and a lower body portion 36. Between the upper body portion 34 and the lower body portion 36 is a waist 38. The main body 30 is narrower at the waist 38 relative to the upper body 34 and the lower body 36.

The container 10 further includes a base 50, which is configured to support the container 10 upright when seated on a planar standing surface 52. Specifically, the base 50 includes a standing ring 54, which extends about the base 50 and has a rigidity sufficient to support the container upright and not deform or "roll out" when subject to carbonation levels of 3.2 g.v. and above, such as 4.2 g.v. The standing ring 54 has a thickness that is greater than a thickness of the sidewall 32. The standing ring 54 may have any suitable thickness, such as a thickness greater than 1 mm (0.040 in.).

A heel 56 extends between the lower body 36 and the standing ring 54. A plurality of dimples 58 are defined by the base 50 and are evenly spaced apart along the standing ring 54.

With continued reference to FIG. 1 and additional reference to FIGS. 2-5, the base 50 will now be described in further detail. The base 50 further includes a center portion 70, which is at a center of the base 50. A longitudinal axis A extends through the center portion 70, as well as through a center of the main body 30 and the finish 12. A diaphragm 72 extends between the center portion 70 and the standing ring 54. The diaphragm 72 is generally curved and provides the base 50 with a generally inwardly extending dome surface, known to those skilled in the art as a "champagne" base. The center portion 70 protrudes outward from the diaphragm 72 and towards the exterior of the base 50 and container 10.

As illustrated in FIGS. 2-5, the plurality of dimples 58 may be evenly spaced apart about the standing ring 54. Any suitable number of dimples 58 may be included, such as 8-14 dimples (particularly 10 or 12 dimples). The dimples 58 may have any suitable size and shape to increase the strength of the standing ring 54.

For example, the dimples 58 may be round, oval, obround, or elliptical. In the example illustrated in FIGS. 2-5, the dimples 58 all have an identical shape and size. In some applications, the dimples 58 may have different sizes and shapes. In the example illustrated, the dimples 58 are shaped and arranged such that the standing ring 54 extends along a line of symmetry of each one of the plurality of dimples 58. From the standing ring 54 each one of the dimples 58 extends along the heel 56 and along the diaphragm 72. The dimples 58 are advantageously arranged about the standing ring 54 so as to form an "X" pattern in relation to the diaphragm 72, which advantageously increases the strength of the base 50.

In the example illustrated, ten dimples 58 are included, and are sized such that the dimples 58 have a total surface area of 4.714 $cm^2$, and border regions 60 of the dimples 58 have a total surface area of 4.839 $cm^2$. The remainder of the base 50 (which includes the heel 56, the center push-up portion 70, the diaphragm 72, and the portions of the standing ring 54 between the border regions 60) has a surface area of 57.503 $cm^2$. Thus in this example, the surface area of the base 50 not including the dimples 58 and border regions 60 is six times greater than the total combined surface area of the dimples 58 and border regions 60. In other words, in this example the base-to-dimple (including border regions 60) ratio is 6:1.

With reference to FIGS. 6-9, an additional dimple configuration for the base 50 in accordance with the present disclosure is illustrated. Specifically, the plurality of dimples include first dimples 58A and second dimples 58B. The first dimples 58A extend from the standing ring 54 to along the diaphragm 72 towards the center push-up portion 70. The second dimples 58B extend generally in an opposite direction from the first dimples 58A. Specifically, the second dimples 58B extend from the standing ring 54 to along the heel 56. The first dimples 58A have a first border region 60A, and the second dimples 58B have a second border region 60B.

The dimples 58A and 58B may have any suitable shape or size. For example, the dimples 58A and/or 58B may be round, oval, obround, or elliptical. The first and second dimples 58A and 58B may be arranged such that each one of the first dimples 58A is between two of the second dimples 58B, and each one of the second dimples 58B is between two of the first dimples 58A.

Figure 7A:
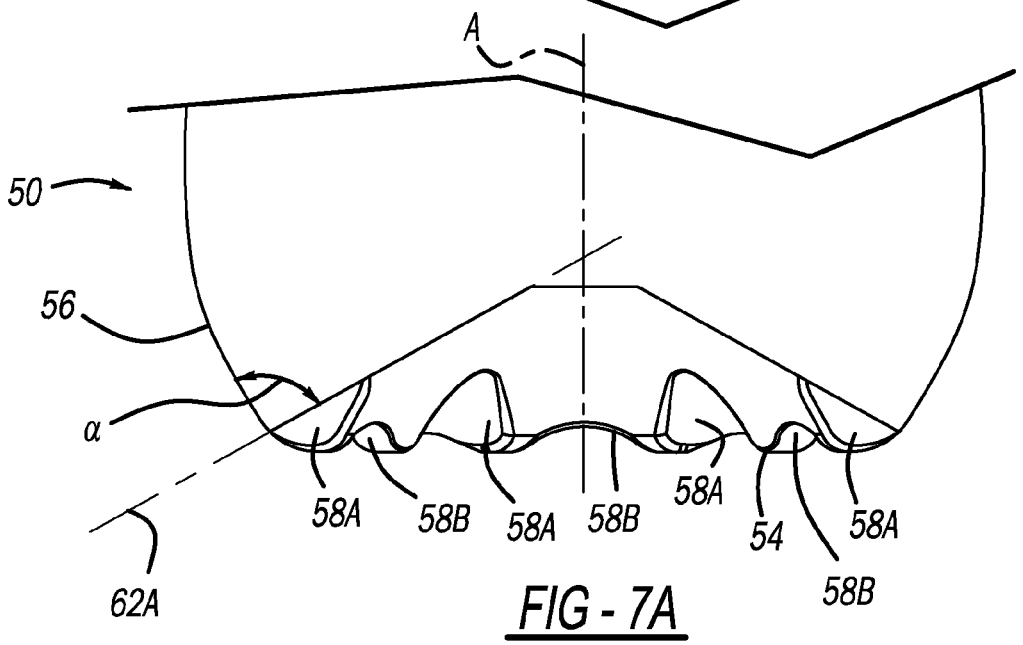
FIG. 7A is a cross-sectional view of the base of FIG. 6.
Figure 7B:
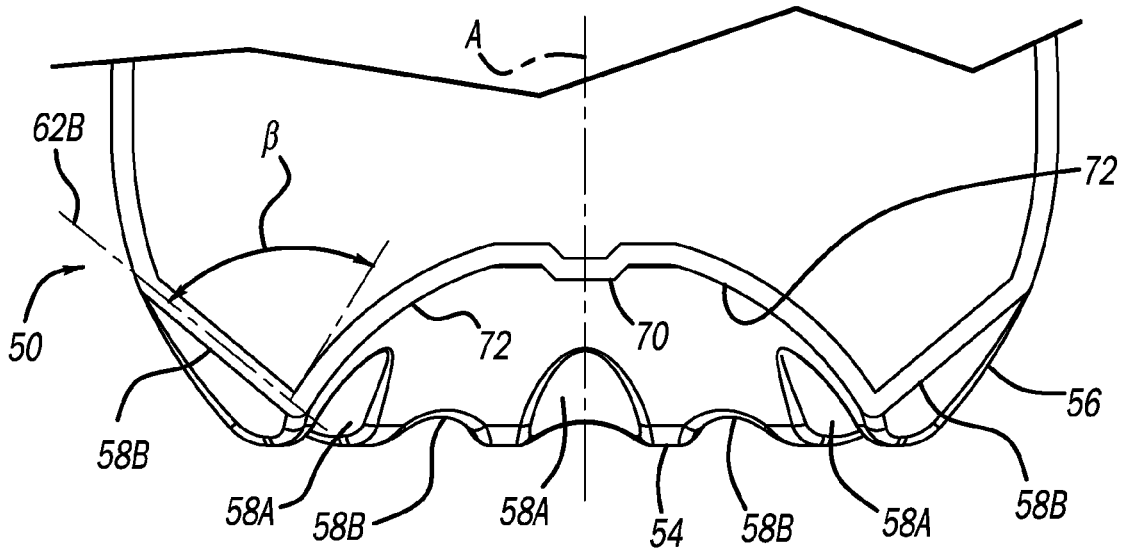
FIG. 7B is an additional cross-sectional view of the base of FIG. 6.
Figure 8:
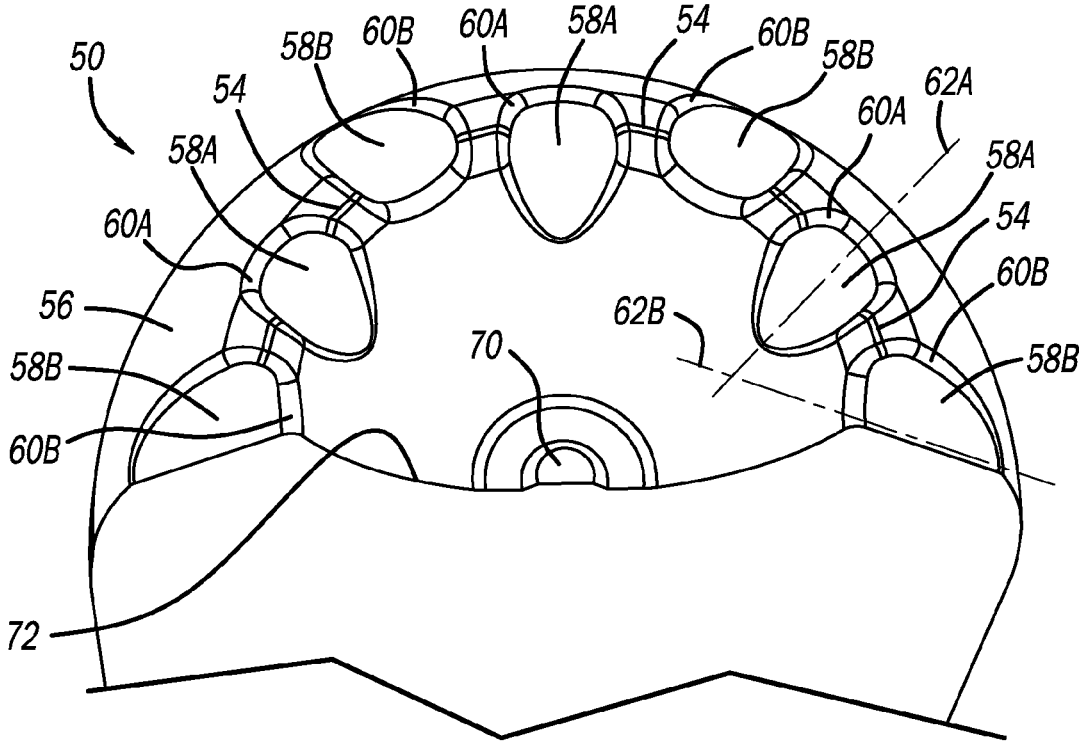
FIG. 8 is another cross-sectional view of the base of FIG. 6.
Figure 9:
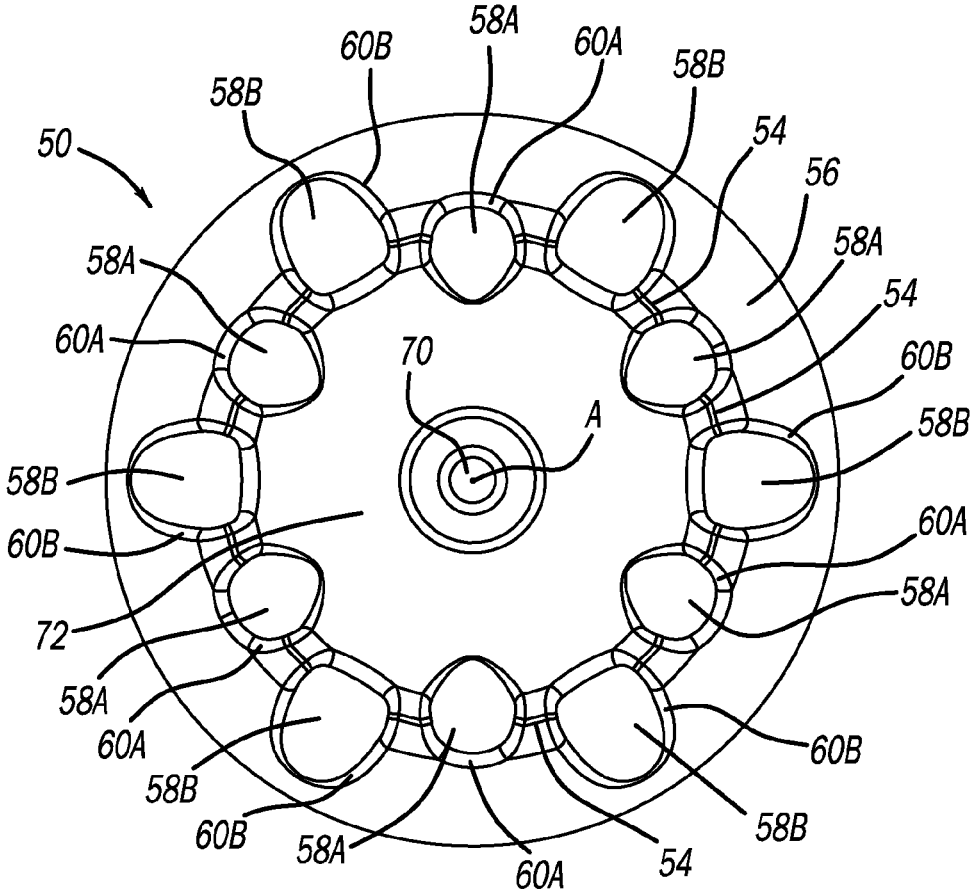
FIG. 9 is a plan view of the base of FIG. 6.
Figure 10:
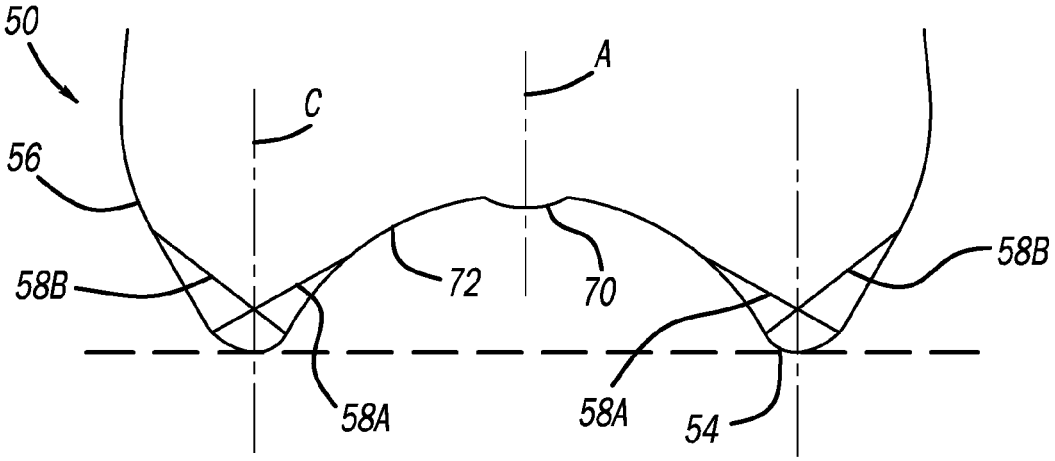
FIG. 10 is a further cross-sectional view of the base of FIG. 6.

With reference to FIGS. 7A and 7B, each one of the first dimples 58A are linear along a longitudinal axis 62A (which is effectively a line of symmetry) extending along the diaphragm 72. Each one of the second dimples 58B are linear along a longitudinal axis 62B (which is effectively a line of symmetry) extending along the heel 56. The first and second dimples 58A and 58B are angled such that each one of the longitudinal axes 62A and 62B extend through the standing ring 54. The dimples 58A intersect the heel 56 along the longitudinal axis 62A forming angle $\alpha$ that is less than 90 degrees (see FIG. 7A). The dimples 58B intersect the diaphragm 72 along the longitudinal axis 62B forming angle $\beta$ that is less than 90 degrees (see FIG. 7B). The dimples 58A, 58B are arranged about the standing ring 54 so as to form an "X" pattern in relation to the diaphragm 72 and heel 56 that converges at the centerline C of standing ring 54 (see FIG. 10), which advantageously increases the strength of the base 50.

Any suitable number of the first and second dimples 58A and 58B may be included. For example, a total of 8-14 first and second dimples 58A and 58B may be included, such as a total of 10 or 12 first and second dimples 58A and 58B. In the example illustrated in FIGS. 6-9, a total of 12 first and second dimples 58A and 58B are included.

The first and second dimples 58A and 58B may have any suitable size. For example, the first dimples 58A may have a total surface area of 3.827 $cm^2$, and the first border regions 60A may have a total surface area of 1.927 $cm^2$. The second dimples 58B may have a total surface area of 6.341 $cm^2$, and the second border regions 60B may have a total surface area of 2.932 $cm^2$. The remainder of the base 50 (which includes the heel 56, the center push-up portion 70, the diaphragm 72, and the portions of the standing ring 54 between the first and second border regions 60A and 60B) may have a total surface area of 49.939 $cm^2$. The ratio of the surface area of the base 50 not including the first dimples 58A, the first border region 60A, the second dimples 58B, and the second border region 60B relative to the first and second dimples 58A, 58B and first and second border regions 60A, 60B may be 3:1. In other words, the total surface area of the base 50 (not including the first and second dimples 58A, 58B and first and second border regions 60A, 60B) may be three times the total surface area of the first and second dimples 58A, 58B and first and second border regions 60A, 60B.

The present disclosure provides numerous advantages over the art. Specifically, the dimples 58, 58A, 58B (and the associated border regions 60, 60A, 60B) advantageously increase the strength of the standing ring 54. This allows the carbonation of the commodity stored within the container 10 to be increased, such as to 3.2 g.v. and above (specifically to 4.2 g.v., for example). Increasing the carbonation of the commodity advantageously increases the shelf life of the commodity. The standing ring 54 with the dimples 58 or 58A/58B advantageously is strong enough to maintain its shape even when the carbonation is increased to 3.2 g.v. and above. Specifically, the base 50 has an improved resistance to "base rollout," which may cause the container 10 to lean or fall over. The container 10 also has improved material distribution at the base 50 and heel 56, and improved pressure versus temperature performance. Furthermore, the standing ring 54 has a thickness that is greater than that of the sidewall 32 to further reduce the possibility of base roll-out. The dimples 58, 58A, and 58B advantageously distribute pressure and base material more evenly about the base 50, which results in uniform movement of the base 50 during pressure changes, thereby increasing the stability of the base and reducing the possibility of base roll-out. The thickest portion of the base 50 is at the standing ring 54, which further increases the stability of the base 50 and reduces the possibility of the base 50 being deformed during pressure changes.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A polymeric container formed from a preform and configured for storing a commodity under pressure, the polymeric container comprising:

a base including a standing ring configured to support the container upright when the standing ring is seated on a planar standing surface;

a curved diaphragm of the base extending from the standing ring to a center of the base; and a plurality of dimples defined by the base and evenly spaced apart along the standing ring:

wherein:

the plurality of dimples includes first dimples and second dimples;

the first dimples have a smaller surface area than the second dimples;

the first dimples are shorter than the second dimples;

each one of the first dimples is between two of the second dimples and each one of the second dimples is between two of the first dimples;

the first dimples extend from the standing surface to along the curved diaphragm of the container, the first dimples intersect the heel along a first longitudinal axis at an angle of less than 90°, the first longitudinal axis extends along a center of a length of each of the first dimples, the first dimples extend linearly and are flat in cross-section along the first longitudinal axis, and the first dimples are symmetrical on opposite sides of the first longitudinal axis;

the second dimples extend from the standing surface to along the heel of the base, the second dimples intersect the curved diaphragm along a second longitudinal axis at an angle of less than 90°, the second longitudinal axis extends along a center of a length of each of the second dimples, the second dimples extend linearly and are flat in cross-section along the second longitudinal axis, and the second dimples are symmetrical on opposite sides of second longitudinal axis;

the first dimples extend further along the curved diaphragm than the second dimples, and the second dimples extend further along the heel than the first dimples;

each one of the first dimples is opposite to another one of the first dimples on opposite sides of the center of the base; and each one of the second dimples is opposite to another one of the second dimples on opposite sides of the center of the base.

2. The container of claim 1, wherein the base is a champagne-style base.

3. The container of claim 1, wherein the standing ring extends along a line of symmetry of each one of the plurality of dimples.

4. The container of claim 1, wherein the base has a surface area ratio of dimples to non-dimples of 3:1.

5. The container of claim 1, wherein the base has a surface area ratio of dimples to non-dimples of 6:1.

6. The container of claim 1, wherein the plurality of dimples are round, oval, obround, or elliptical in shape.

7. The container of claim 1, wherein the container is configured to store the commodity having a $CO_2$ level of at least 3.2 gv.

8. The container of claim 1, wherein the container is configured to store the commodity having a $CO_2$ level of at least 4.2 gv.

9. The container of claim 1, wherein the container includes a body between the base and a finish of the container, the body includes a sidewall having a sidewall thickness that is thinner than a base thickness of the base at the standing ring.

10. The container of claim 1, wherein the container includes 8-14 of the plurality of dimples.

11. The container of claim 1, wherein the plurality of dimples form an "X" pattern in relation to the curved diaphragm.

12. The container of claim 1, further comprising a body defining an internal volume of the container, the body includes an upper body portion, a lower body portion, and a waist between the upper body portion and the lower body portion;

wherein the body is narrower at the waist as compared to the upper body portion and the lower body portion.

13. The container of claim 1 wherein the first longitudinal axes and the second longitudinal axes intersect in cross-section at a centerline of the standing ring.

14. The container of claim 1, wherein the curved diaphragm includes a center portion at an axial center of the curved diaphragm, the center portion protrudes outwardly from the curved diaphragm away from an interior volume of the container.

* * * * *